US011292249B2

(12) United States Patent
Yamagishi et al.

(10) Patent No.: US 11,292,249 B2
(45) Date of Patent: Apr. 5, 2022

(54) IMAGE FORMING APPARATUS

(71) Applicant: KYOCERA Document Solutions Inc., Osaka (JP)

(72) Inventors: Yoshihiro Yamagishi, Osaka (JP); Kanako Morimoto, Osaka (JP); Ryota Okui, Osaka (JP); Satoshi Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/931,065

(22) Filed: Jul. 16, 2020

(65) Prior Publication Data

US 2021/0016564 A1 Jan. 21, 2021

(30) Foreign Application Priority Data

Jul. 19, 2019 (JP) ..... JP2019-133961

(51) Int. Cl.
*B41J 2/045* (2006.01)

(52) U.S. Cl.
CPC ..... *B41J 2/04571* (2013.01); *B41J 2/04563* (2013.01); *B41J 2/04566* (2013.01); *B41J 2/04581* (2013.01)

(58) Field of Classification Search
CPC .. B41J 2/0451; B41J 2/04571; B41J 2/04566; B41J 2/04563; B41J 2/165; B41J 2/16579
See application file for complete search history.

(56) References Cited

U.S. PATENT DOCUMENTS

2019/0090609 A1* 3/2019 Shimizu ..... A45D 29/14
2020/0238692 A1* 7/2020 Hasegawa ..... B41J 2/04563

FOREIGN PATENT DOCUMENTS

JP 6106874 B2 4/2017

* cited by examiner

*Primary Examiner* — Scott A Richmond
(74) *Attorney, Agent, or Firm* — Studebaker & Brackett PC

(57) ABSTRACT

An image forming apparatus includes a recording head, a controller, a first detector, and a second detector. The controller calculates a viscosity of ink in each of nozzles based on a temperature, a humidity, and an elapsed time. The controller determines, among the nozzles, a nozzle in which the viscosity is equal to or higher than a threshold to be a high-viscosity nozzle. The controller acquires non-ejection information indicating an ejection disabled nozzle that is disabled to eject the ink. The controller acquires a viscosity of the ink in the ejection disabled nozzle. The controller calculates an average value of viscosities of the ink in the plurality of nozzles. The controller compares the viscosity of the ink in the ejection disabled nozzle with the average value of the viscosities of the ink in the nozzles. The controller determines whether or not to change a contribution value based on a comparison result.

5 Claims, 12 Drawing Sheets

IMAGE FORMING APPARATUS

INCORPORATION BY REFERENCE

The present application claims priority under 35 U.S.C. § 119 to Japanese Patent Application No. 2019-133961, filed on Jul. 19, 2019. The contents of this application are incorporated herein by reference in their entirety.

BACKGROUND

The present disclosure relates to an image forming apparatus.

An image forming apparatus includes a liquid ejection head, a laser sensor, and a print controller. The liquid ejection head includes pressure chambers and piezoelectric elements. The pressure chambers contain ink therein. The pressure chambers include nozzles. The nozzles eject the ink for forming an image on a recording medium. The piezoelectric elements change volumes of the pressure chambers to eject the ink from the nozzles. The laser sensor irradiates ink ejected from the nozzles with a laser to detect reflected light. The print controller controls each piezoelectric element. Specifically, the print controller detects presence or absence of an ejection disabled nozzle that is not to eject the ink based on output of the laser sensor. When detecting an ejection disabled nozzle, the print controller applies a drive waveform to a piezoelectric element corresponding to the ejection disabled nozzle to cause the ejection disabled nozzle to perform idle ejection. The idle ejection refers to ejection of a droplet that does not contribute to image formation.

SUMMARY

The image forming apparatus according to an aspect of the present disclosure includes a recording head, a controller, a first detector, and a second detector. The recording head includes a plurality of nozzles that eject ink. The recording head is configured to form an image on a sheet with the ink. The controller is configured to control the recording head. The first detector is configured to detect a temperature around the recording head. The second detector is configured to detect a humidity around the recording head. The controller acquires, for each of the nozzles, an elapsed time that has elapsed from ink ejection. The controller calculates, for each of the nozzles, a viscosity of the ink in the nozzle based on the temperature, the humidity, and the elapsed time. The controller determines, for each of the nozzle, whether or not the viscosity is equal to or higher than a threshold. The controller determines, among the plurality of nozzles, nozzles in each of which the viscosity is equal to or higher than the threshold as high-viscosity nozzles. The controller acquires non-ejection information indicating an ejection disabled nozzle that cannot eject ink. The controller acquires the viscosity of the ink in the ejection disabled nozzle based on the non-ejection information. The controller calculates an average value of viscosities of the ink in the plurality of nozzles. The controller compares the viscosity of the ink in the ejection disabled nozzle with the average value of the viscosities of the ink in the plurality of nozzles. The controller determines whether or not to change a contribution value based on a comparison result of the viscosity of the ink in the ejection disabled nozzle with the average value of the viscosities of the ink in the nozzles. The contribution value is a value that contributes to a result of determination by the controller as to whether or not each of the nozzles is the high-viscosity nozzle.

DETAILED DESCRIPTION

Figure 1:
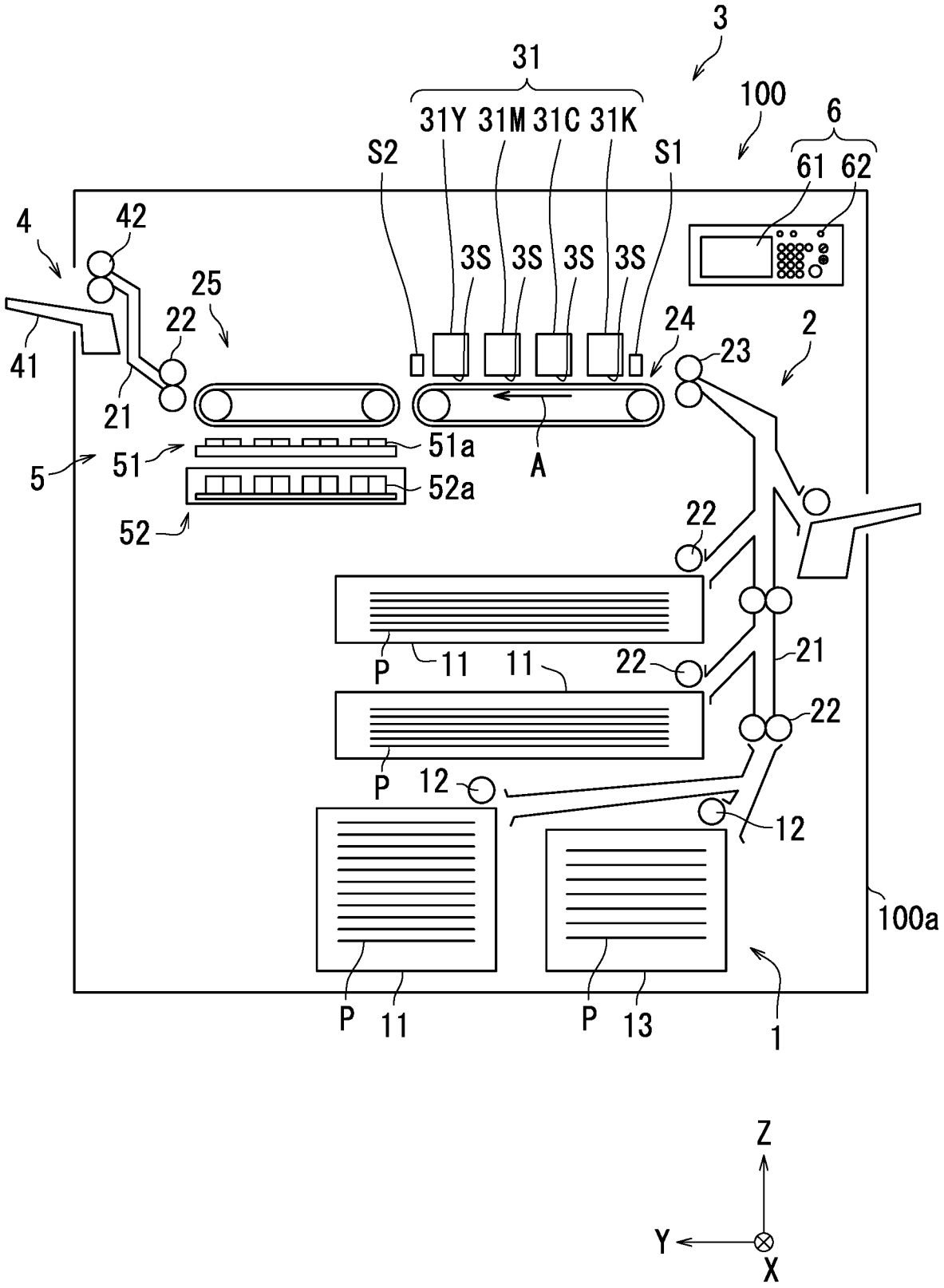
FIG. 1 is a diagram illustrating a configuration of an image forming apparatus according to an embodiment of the present disclosure.

The following describes an embodiment of an image forming apparatus according to the present disclosure with reference to drawings. Elements which are the same or equivalent are labeled with the same reference signs in the drawings and description thereof is not repeated. In the embodiment of the present disclosure, X, Y, and Z axes orthogonal to each other are shown in the drawings. The Z axis is parallel to a vertical line, and the X and Y axes are parallel to a horizontal plane.

A configuration of an image forming apparatus 100 according to the present embodiment will be described with reference to FIG. 1. FIG. 1 is a diagram illustrating a configuration of the image forming apparatus 100 according to the present embodiment.

The image forming apparatus 100 forms an image on a sheet P with ink. As illustrated in FIG. 1, the image forming apparatus 100 includes a housing 100*a*, a sheet feed section 1, a sheet conveyance section 2, an image forming section 3, an ejection section 4, a cleaner 5, an operation panel 6, a first detector S1, and a second detector S2. The first detector S1 will be referred to below as "temperature sensor S1". The second detector S2 will be referred to below as "humidity sensor S2". The housing 100*a*, houses the sheet feed section 1, the sheet conveyance section 2, the image forming section 3, the ejection section 4, the cleaner 5, the temperature sensor S1, and the humidity sensor S2.

The image forming section 3 ejects ink to form an image on a sheet P. In the present embodiment, the image forming section 3 includes four lineheads 31. The lineheads 31 each has a nozzle surface 3S. In each nozzle surface 3S nozzles 30 are formed, which will be described with reference to FIG. 3. The respective four lineheads 31 eject a yellow ink, a magenta ink, a cyan ink, and a black ink. Hereinafter, the linehead 31 that ejects the yellow ink may be referred to as "linehead 31Y", the linehead 31 that ejects the magenta ink may be referred to as "linehead 31M", the linehead that ejects the cyan ink may be referred to as "linehead 31C", and the linehead 31 that ejects the black ink may be referred to as "linehead 31K". The lineheads 31K, 31C, 31M, 31Y are arranged in this order in the conveyance direction of the sheet P. The inks include a water-based ink. In the present embodiment, each ink is a water-based ink.

The sheet feed section 1 accommodates sheets P. The sheet feed section 1 includes sheet feeding cassettes 11 and sheet feed rollers 12. The sheet feed cassettes 11 each accommodate at least a sheet P. The sheet feed rollers 12 send out the sheet P to the sheet conveyance section 2.

The sheet conveyance section 2 conveys the sheet P to the ejection section 4. Specifically, the sheet conveyance section 2 includes conveyance guides 21, conveyance roller pairs 22, a registration roller pair 23, a first conveyance unit 24, and a second conveyance unit 25. The conveyance guides 21 constitute a conveyance path for the sheet P. The conveyance roller pairs 22 convey the sheet P along the conveyance path. The registration roller pair 23 adjusts timing of conveyance of the sheet P to the first conveyance unit 24 according to timing at which the image forming section 3 ejects ink. The first conveyance unit 24 faces the nozzle surfaces 3S of the four lineheads 31. The first conveyance unit 24 conveys the sheet P in an area immediately below the nozzle surfaces 3S of the four lineheads 31. The second conveyance unit 25 conveyances the sheet P sent out from the first conveyance unit 24 toward the ejection section 4.

The ejection section 4 ejects the sheet P out of the housing 100*a*. The ejection section 4 includes an exit tray 41 and an ejection roller pair 42. The ejection roller pair 42 sends out the sheet P to the exit tray 41.

The cleaner 5 cleans the four lineheads 31. The cleaner 5 is positioned below the second conveyance unit 25 during image formation on the sheet P, and moves to a position immediately below the four lineheads 31 at the time of cleaning of the four lineheads 31. Not that at the time of cleaning of the four lineheads 31, the first conveyance unit 24 has moved to a retraction position. The retraction position is a position where the first conveyance unit 24 does not collide with the cleaner 5.

The cleaner 5 includes a capping section 51 and a wiping section 52. The capping section 51 includes capping members 51*a*. The capping members 51*a* cap the nozzle surfaces 3S of the four lineheads 31 to provide an environment in which ink hardly dries.

The wiping section 52 cleans the nozzle surfaces 3S of the four lineheads 31. Specifically, the wiping section 52 includes wiper blades 52*a*. The wiper blades 52*a* contains for example a resin as a material. The wiper blades 52*a* are cleaning members that clean the nozzle surfaces 3S.

The nozzle surfaces 3S of each linehead 31 constitute part of the lower surface of the linehead 31. The wiping section 52 moves the wiper blades 52*a* while keeping the wiper blades 52*a* in contact with the lower surfaces of the four lineheads 31. As a result, the nozzle surfaces 3S are wiped by the wiper blades 52*a* and the nozzle surfaces 3S are cleaned. Specifically, ink attached to the nozzle surfaces 3S is wiped off by the wiper blades 52*a*.

The operation panel 6 receives an instruction from a user. The operation panel 6 includes a display section 61 and operation buttons 62. The display section 61 displays various processing results. The operation buttons 62 include a start button, arrow keys, and a numeric keypad. The start button is a button for causing the image forming apparatus 100 to execute various functions (processes). The arrow keys are buttons for changing a selection target. The numeric keypad is a set of buttons for inputting a numerical value.

The temperature sensor S1 measures a temperature around the nozzle surfaces 3S of the four lineheads 31.

The humidity sensor S2 measures a humidity around the nozzle surfaces 3S of the four lineheads 31.

Figure 2:
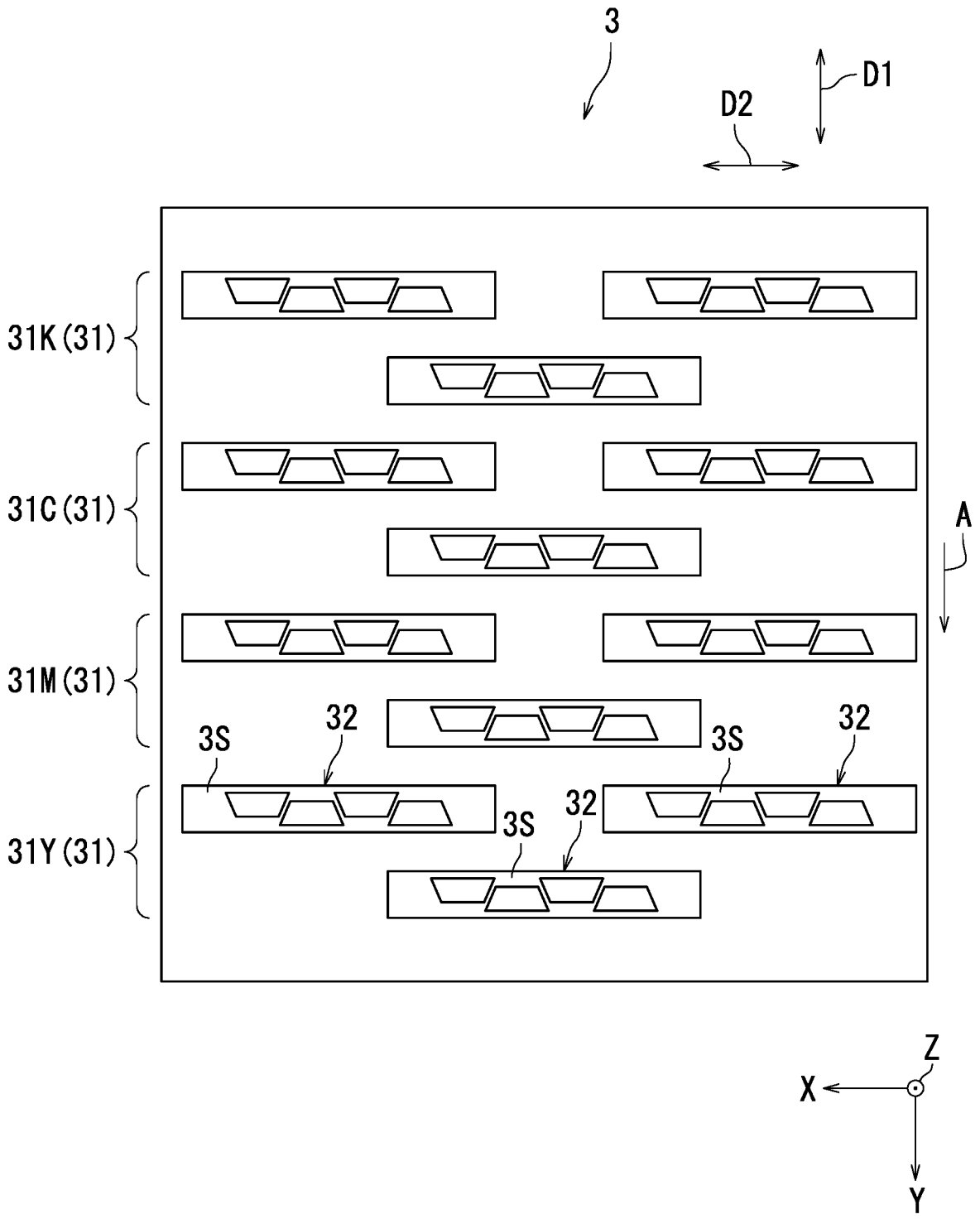
FIG. 2 is a diagram illustrating an arrangement of line-heads in the embodiment of the present disclosure.

Next, a configuration of the lineheads 31 will be described with reference to FIG. 2. FIG. 2 is a diagram illustrating a configuration of the lineheads 31 in the present embodiment. Specifically, FIG. 2 illustrates the image forming section 3 as viewed from the side of the first conveyance unit 24 described above with reference to FIG. 1. Aside from ejecting inks of different colors, the lineheads 31Y, 31M, 31C, and 31K all have the same configuration as one another. The configuration of the lineheads 31 will be described using the linehead 31Y as an example with reference to FIG. 2.

As illustrated in FIG. 2, the linehead 31Y includes three recording heads 32. The three recording heads 32 are arranged in a staggered pattern in a main scanning direction D2 (X-axis direction).

Figure 3:
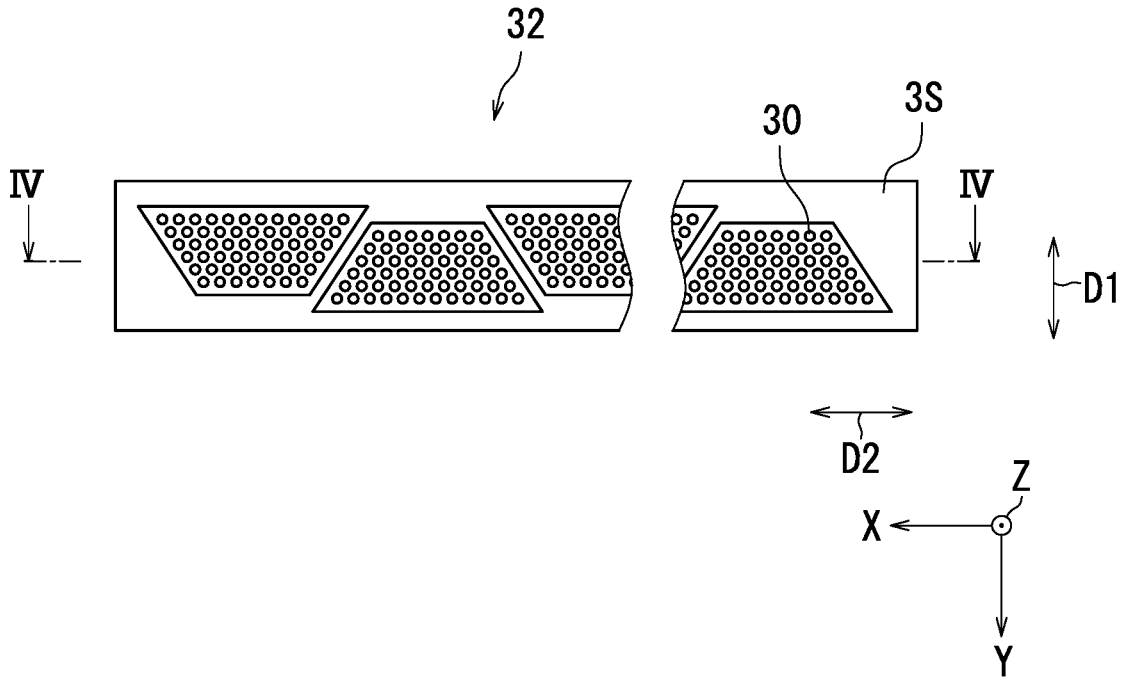
FIG. 3 is a diagram illustrating a configuration of a recording head in the embodiment of the present disclosure.
Figure 4:
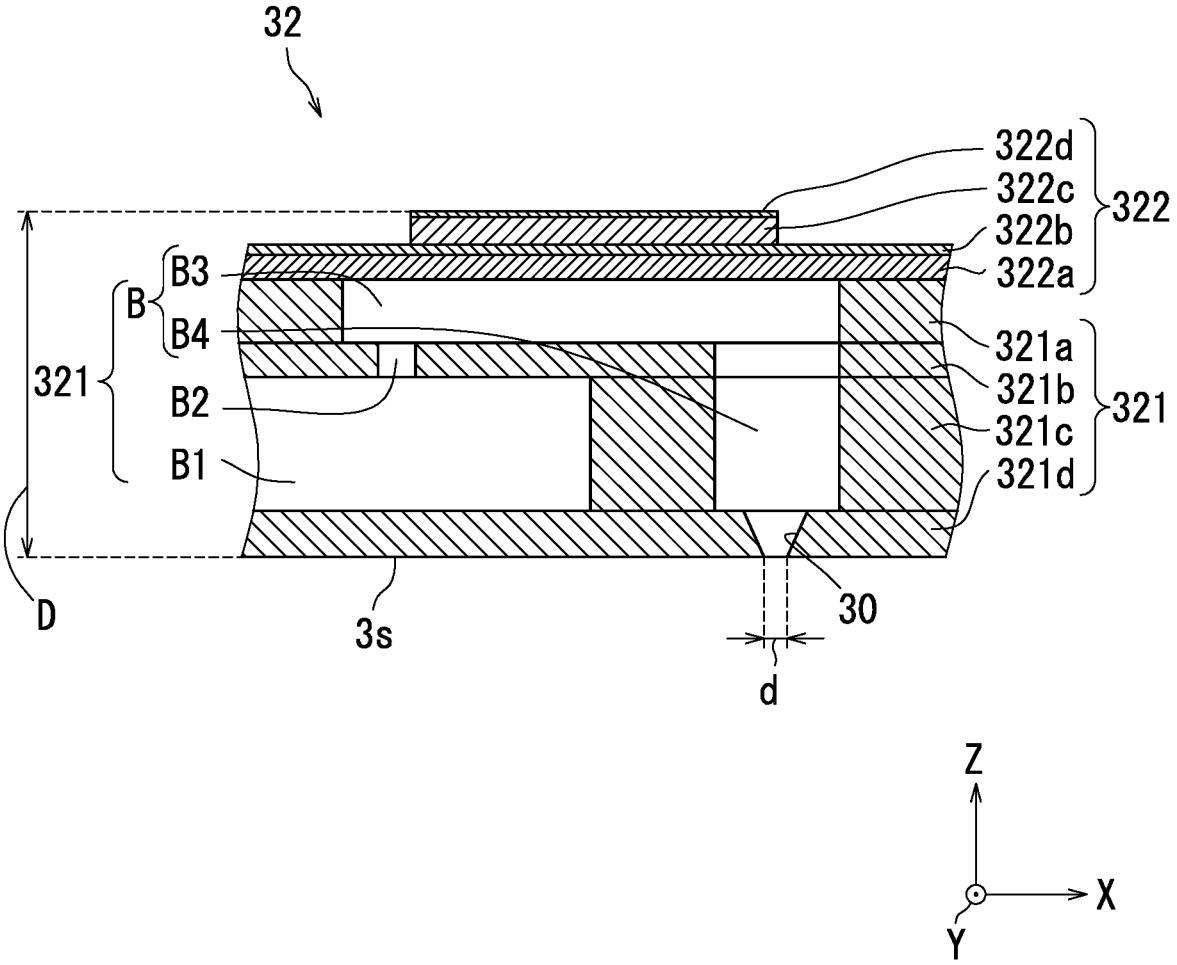
FIG. 4 is a partial enlarged view of a cross section taken along the line IV-IV in FIG. 3.

Next, a configuration of the recording heads 32 will be described with reference to FIGS. 3 and 4. FIG. 3 is a diagram illustrating a configuration of the recording head 32 in the present embodiment. Specifically, FIG. 3 illustrates the nozzle surfaces 3S of a recording head 32. FIG. 4 is an enlarged view of part of a cross section taken along the line IV-IV in FIG. 3.

The recording head 32 forms an image on a sheet P with ink. As illustrated in FIG. 3, the recording head 32 includes a plurality of nozzles 30. The plurality of nozzles 30 are arranged in a sub-scanning direction D1 (Y-axis direction) and the main scanning direction D2 (X-axis direction). The nozzles 30 each eject ink.

As illustrated in FIG. 4, the recording head 32 includes a flow path 321 and a driving section 322 in addition to the nozzles 30.

The flow path 321 forms a manifold B1, supplies B2, cavities B3, and descenders B4. Each supply B2, each cavity B3, and each descender B4 are provided for a corresponding nozzle 30 described above with reference to FIG. 3. Each of the manifold B1, the supplies B2, the cavities B3, and the descenders B4 is a space.

The flow path 321 includes an ink tank that stores ink. Specifically, the ink tank of each recording head 32 included in the linehead 31K stores a black ink. The ink tank of each recording head 32 included in the linehead 31C stores a cyan ink. The ink tank of each recording head 32 included in the linehead 31M stores a magenta ink. The ink tank of each recording head 32 included in the linehead 31Y stores a yellow ink.

The manifold B1 is connected to the ink tank. Ink flows from the ink tank into the manifold B1. The manifold B1 communicates with each cavity B3 via a corresponding supply B2. Each cavity B3 communicates with a corresponding descender B4. Each descender B4 communicates with a corresponding nozzle 30. The cavity B3 and the descender B4 form a corresponding pressure chamber B.

The pressure chamber B contains ink therein and communicates with the corresponding nozzle 30.

The flow path 321 includes a cavity plate 321*a*, a supply plate 321*b*, a manifold plate 321*c*, and a nozzle plate 321*d*. The cavity plate 321*a*, the supply plate 321*b*, the manifold plate 321*c*, and the nozzle plate 321*d* are stacked in this order.

The cavity plate 321*a* has through holes corresponding to the cavities B3. The supply plate 321*b* has through holes corresponding to the supplies B2 and the descenders B4. The manifold plate 321*c* has through holes corresponding to the manifold B1 and the descenders B4. The nozzle plate 321*d* has through holes corresponding to the nozzles 30. The nozzle plate 321*d* constitutes the nozzle surfaces 3S. The through holes corresponding to the nozzles 30 have a diameter of for example 20 μm or less. The diameter d of the through holes corresponding to the nozzles 30 will be referred to below as "nozzle diameter d".

The driving section 322 applies pressure to ink in the pressure chambers B to cause ejection of ink from the nozzles 30. The driving section 322 is arranged for the pressure chambers B. The driving section 322 includes a vibration plate 322*a*, a common electrode 322*b*, a plurality of piezoelectric elements 322*c*, and a plurality of individual electrodes 322*d*. The vibration plate 322*a*, the common electrode 322*b*, the piezoelectric elements 322*c*, and the individual electrodes 322*d* are arranged in this order in a direction away from the nozzle surface 3S.

The vibration plate 322*a* constitutes a wall of each pressure chamber B that is located opposite to the nozzle surfaces 3S. The vibration plate 322*a* and the common electrode 322*b* continuously extend over the pressure chambers B. The piezoelectric elements 322*c* and the individual electrodes 322*d* correspond to the respective pressure chambers B. The piezoelectric elements 322*c* are sandwiched between the common electrode 322*b* and the respective individual electrodes 322*d*. Each piezoelectric element 322*c* includes a piezo element or a lead zirconate titanate (PZT) element. The thickness D from the lower surface of the nozzle plate 321*d* to the upper surface of the piezoelectric element 322*c* is for example 1 mm or less.

Figure 5:
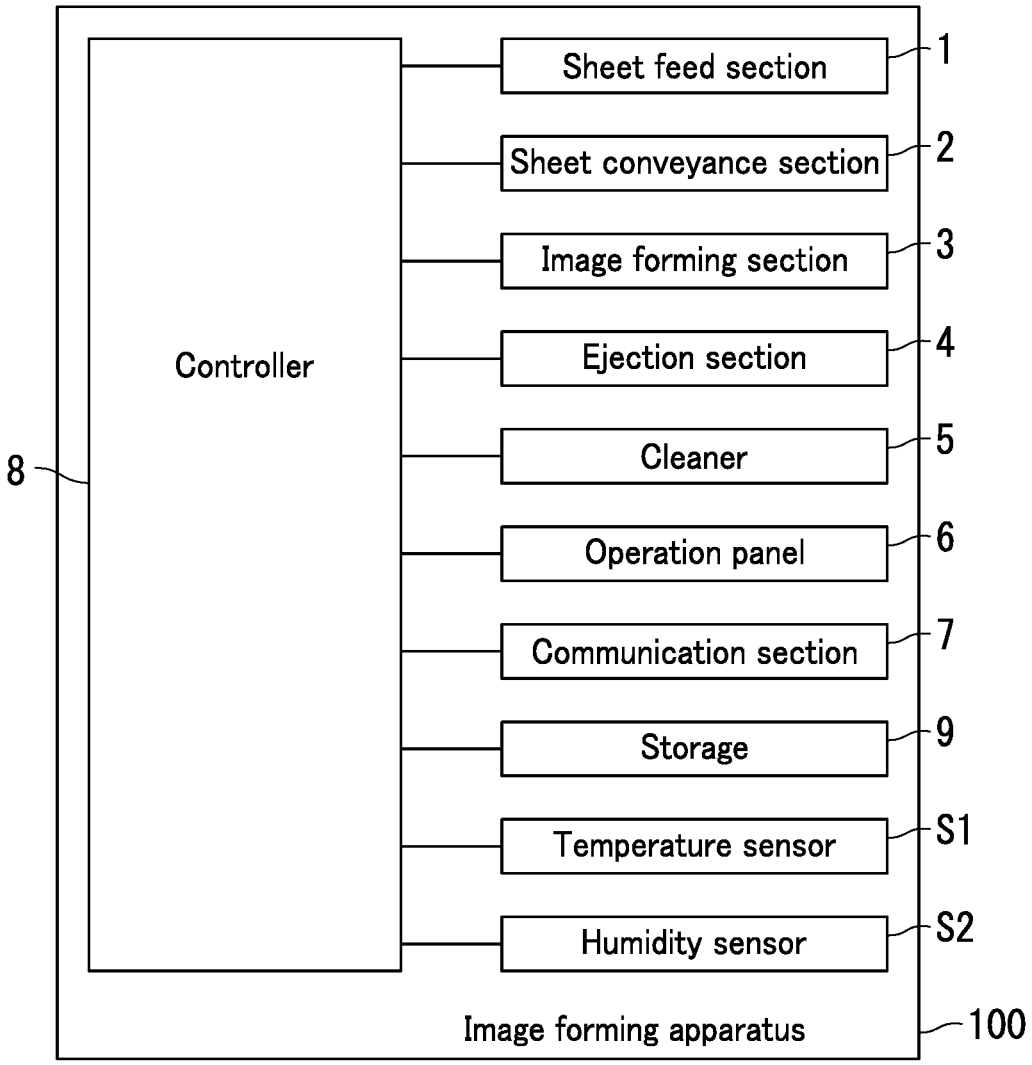
FIG. 5 is a block diagram illustrating a configuration of the image forming apparatus according to the embodiment of the present disclosure.
Figure 6:
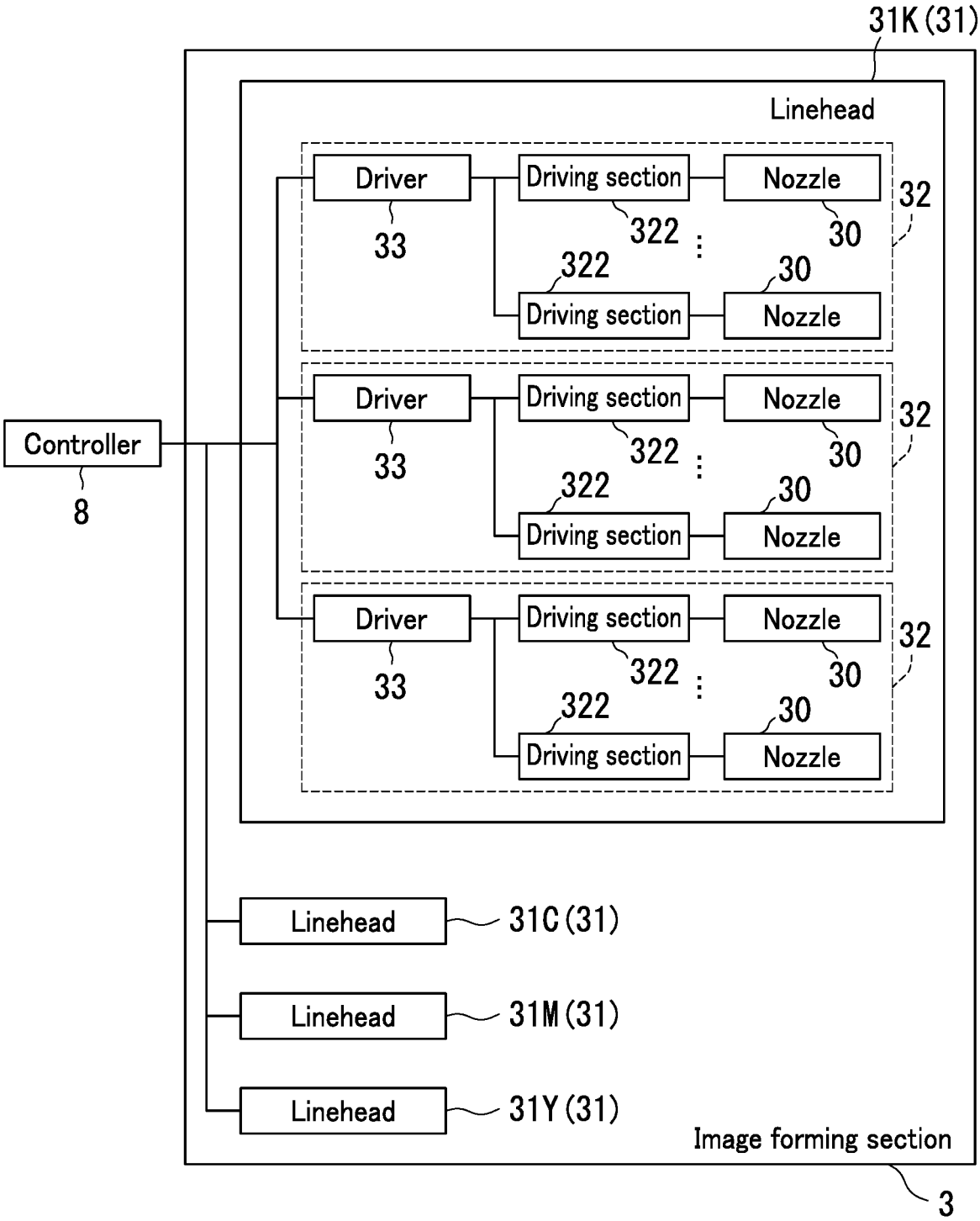
FIG. 6 is a block diagram illustrating a configuration of the image forming apparatus according to the embodiment of the present disclosure.

The following further describes the configuration of the image forming apparatus 100 with reference to FIGS. 1 to 6. FIGS. 5 and 6 are each a block diagram illustrating a configuration of the image forming apparatus 100 in the present embodiment.

As illustrated in FIG. 5, the image forming apparatus 100 further includes a communication section 7, a controller 8, and storage 9.

The communication section 7 communicates with an external terminal via a network. That is, the communication section 7 sends and receives data to and from the external terminal via the network. The external terminal includes an information processing device 200 and a scanner 300, which will be described with reference to FIG. 8. The communication section 7 is a communication interface.

The controller 8 is a hardware circuit including a processor such as a central processing unit (CPU). The controller 8 executes a first control program to control operation of the sheet feed section 1, the sheet conveyance section 2, the image forming section 3, the ejection section 4, the cleaner 5, the operation panel 6, the communication section 7, and the storage 9. The controller 8 includes an integrated circuit for image forming process. The integrated circuit for image forming process includes for example an application specific integrated circuit (ASIC).

The controller 8 receives a signal transmitted from the temperature sensor S1. The signal transmitted from the temperature sensor S1 indicates a temperature around the nozzle surfaces 3S of the four lineheads 31 described above with reference to FIG. 1. In other words, the signal transmitted from the temperature sensor S1 indicates a temperature around the nozzle surfaces 3S of the recording heads 32. The controller 8 receives a signal transmitted from the humidity sensor S2. The signal transmitted from the humidity sensor S2 indicates a humidity around the nozzle surfaces 3S of the four lineheads 31 described above with reference to FIG. 1. In other words, the signal transmitted from the humidity sensor S2 indicates a humidity around the nozzle surfaces 3S of the recording heads 32. The controller 8 measures, for each of the nozzles 30, an elapsed time that has elapsed from ink ejection. The controller 8 counts the number of sheets P on which an image has been formed. In the present embodiment, the controller 8 causes execution of a forced ejection process, a test-pattern-image forming process, and a cleaning process. The forced ejection process, the test-pattern-image forming process, and the cleaning process execution of which the controller 8 causes will be described later with reference to FIGS. 9 to 12.

The storage 9 stores data therein. The storage 9 includes a storage device and semiconductor memory. The storage device includes for example either or both of a hard disk drive (HDD) and a solid state drive (SSD). The semiconductor memory includes random-access memory (RAM) and read-only memory (ROM). The storage 9 stores the first control program therein. The storage 9 stores image data. The storage 9 stores image data for forming an image on a sheet P. The storage 9 stores therein test pattern image data for displaying a test pattern image.

The test pattern image is an image for detecting whether or not each of the nozzles 30 is an ejection disabled nozzle 30A. The ejection disabled nozzle 30A is a nozzle 30 disabled from ink ejection. Any nozzle 30 can become the ejection disabled nozzle 30A due to a fault such as clogging of a nozzle 30. Specifically, when the viscosity of the ink in a nozzle 30 increases, the nozzle 30 is clogged. The storage 9 stores a counted sheet number. The counted sheet number is a value obtained by the controller 8 counting the number of sheets P on which an image has been formed by the image forming section 3. In other words, the counted sheet number is a cumulative number of sheets P on which an image has been formed by the image forming section 3.

As illustrated in FIG. 6, each recording head 32 further includes a driver 33. The driver 33 controls ink ejection from corresponding nozzles 30. Specifically, the driver 33 turns on and off for application of a drive voltage to the individual electrodes 322*d*. The drive voltage is an example of a drive signal.

The following further describes ink ejection control with reference to FIGS. 1 to 6.

The controller 8 transmits image data to the drivers 33 line by line in the main scanning direction D2. The image data is binary data that indicates ejection or non-ejection of ink. Each driver 33 applies a pulsed drive voltage to an individual electrode 322*d* corresponding to a nozzle 30 that is to eject ink. When the drive voltage is applied to the individual electrode 322*d*, the shape of a corresponding piezoelectric element 322*c* changes. When the shape of the piezoelectric element 322*c* changes, the pressure of the ink in a corresponding pressure chamber B increases. When the pressure of the ink in the pressure chamber B increases, the ink in the pressure chamber B is ejected from the nozzle 30. To an individual electrode 322*d* corresponding to a nozzle 30 that is not to eject ink, a corresponding driver 33 does not apply a drive voltage.

Figure 7A:
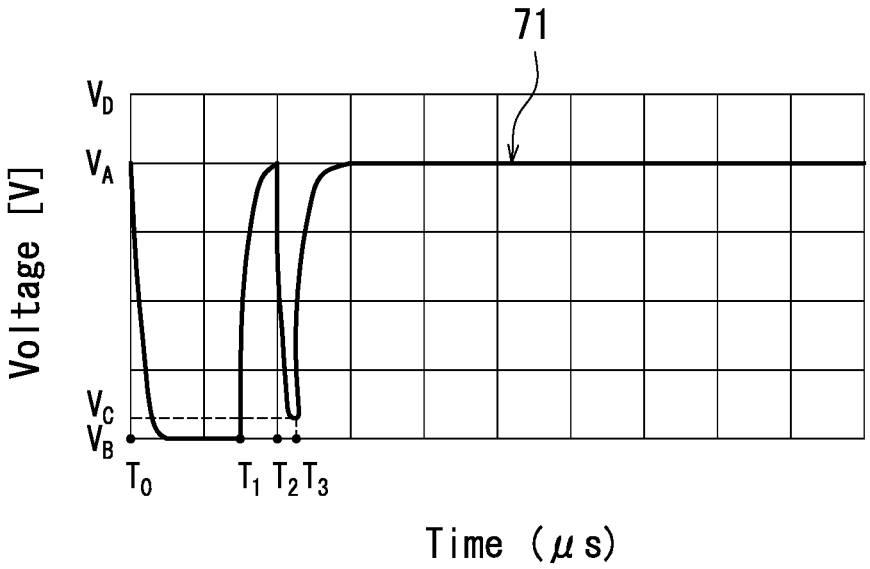
FIGS. 7A and 7B are diagrams illustrating drive waveforms applied to a piezoelectric element in the embodiment of the present disclosure.
Figure 7B:
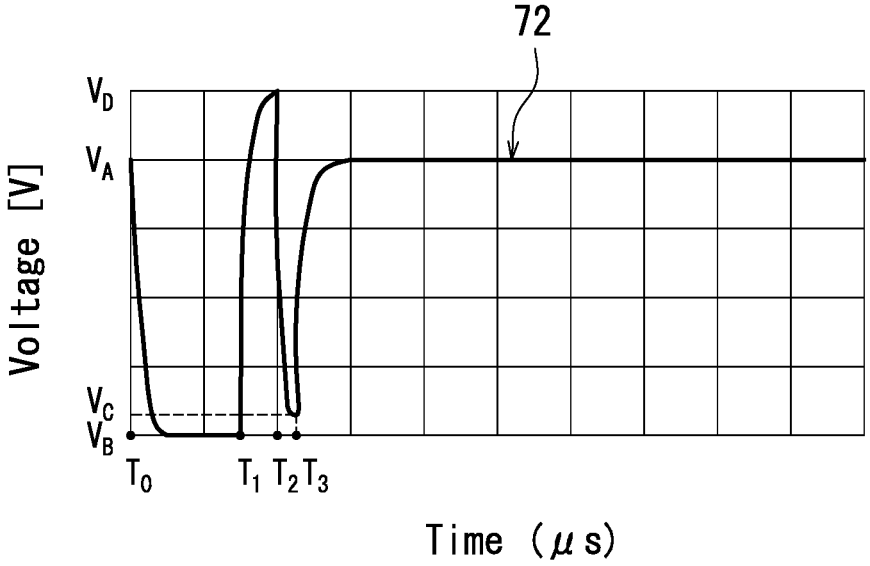

The following further describes the drive voltage applied to the individual electrodes 322*d* under control of the controller 8, with reference to FIGS. 7A and 7B. FIGS. 7A and 7B are diagrams illustrating drive waveforms of the drive voltage applied to a piezoelectric element 322*c* in the present embodiment. Specifically, FIG. 7A illustrates a first drive waveform 71. FIG. 7B illustrates a second drive waveform 72.

The viscosity of the ink in each nozzle 30 gradually increases with a lapse of time when ink is not ejected from the nozzle 30 due to for example evaporation of water. As a result, the viscosity of the ink in the nozzle 30 may become equal to or greater than a threshold with a lapse of time when ink is not ejected from the nozzle 30. A nozzle 30 in which the viscosity of ink is equal to or higher than the threshold may become an ejection disabled nozzle 30A. A nozzle 30 in which the viscosity of ink is equal to or higher than the threshold may be referred to below as "high-viscosity nozzle 30B". A nozzle 30 other than the ejection disabled nozzle 30A and the high-viscosity nozzle 30B may be referred to below as "normal nozzle 30C". The high-viscosity nozzle 30B has a viscosity of ink equal to or higher than the threshold and less than the viscosity of the ink in the ejection disabled nozzle 30A. The high-viscosity nozzle 30B is more likely to be the ejection disabled nozzle 30A than the normal nozzle 30C. The threshold is for example a viscosity lower than a viscosity value measured for ink in the ejection disabled nozzle 30A.

First, the first drive waveform 71 will be described with reference to FIG. 7A. The first drive waveform 71 is a waveform of a drive voltage applied to an individual electrode 322*d* corresponding to the normal nozzle 30C. The individual electrodes 322*d* each corresponding to the normal nozzle 30C may be referred to below as "normal individual electrode 322*d*C".

As illustrated in FIG. 7A, the controller 8 drops the drive voltage applied to the normal individual electrode 322*d*C at time $T_0$ to execute ink ejection from the normal nozzle 30C. Specifically, the controller 8 lowers the drive voltage from a first voltage value $V_A$ to a second voltage value $V_B$. As a result, the ink meniscus in the normal nozzle 30C changes from a concave state recessed into the normal nozzle 30C to a convex state protruding outside the normal nozzle 30C. Next, the controller 8 raises the drive voltage applied to the normal individual electrode 322*d*C at time $T_1$. Specifically, the controller 8 raises the drive voltage from the second voltage value $V_B$ to the first voltage value $V_A$. As a result, the ink meniscus in the normal nozzle 30C changes from the convex state protruding outside the normal nozzle 30C to the concave state recessed into the normal nozzle 30C. Next, the controller 8 lowers the drive voltage applied to the normal individual electrode 322*d*C at time $T_2$. Specifically, the controller 8 lowers the drive voltage from the first voltage value $V_A$ to a third voltage value $V_C$. The third voltage value $V_C$ is higher than the second voltage value $V_B$. As a result, the ink meniscus in the normal nozzle 30C changes from the concave state recessed into the normal nozzle 30C to the convex state protruding outside the normal nozzle 30C. Next, the controller 8 raises the drive voltage applied to the normal individual electrode 332*d*C at time $T_3$. Specifically, the controller 8 raises the drive voltage from the third voltage value $V_C$ to the first voltage value $V_A$. As a result, the ink meniscus in the normal nozzle 30C changes from the convex state protruding outside the normal nozzle 30C to the concave state recessed into the normal nozzle 30C. At this time, a portion of the ink in the normal nozzle 30C that is impossible to follow the change of the meniscus is separated and ejected from the normal nozzle 30C. In this way, the controller 8 controls the drive voltage applied to the normal individual electrode 322*d*C to cause ink ejection from the normal nozzle 30C.

Next, the second drive waveform 72 will be described with reference to FIG. 7B. The second drive waveform 72 is a waveform of a drive voltage applied to an individual electrode 322*d* corresponding to the high-viscosity nozzle 30B. The individual electrodes 322*d* each corresponding to the high-viscosity nozzle 30B may be referred to below as "high-viscosity individual electrode 322*d*B".

As illustrated in FIG. 7B, the second drive waveform 72 is different from the first drive waveform 71 in the voltage value at time $T_2$. Specifically, the controller 8 raises the drive voltage from the second voltage value $V_B$ to a fourth voltage value $V_D$ at time $T_1$ to cause the high-viscosity nozzle 30B to eject ink. The fourth voltage value $V_D$ is higher than the first voltage value $V_A$. That is, in the present embodiment, the controller 8 controls the drive voltage in such a way that the difference in the drive voltage input to piezoelectric elements 322*c* each corresponding to the high-viscosity nozzle 30B is larger than the difference in the drive voltage input to piezoelectric elements 322*c* each corresponding to the normal nozzle 30C. As a result, the piezoelectric elements 322*c* each corresponding to the high-viscosity nozzle 30B change in shape greater than the piezoelectric elements 322*c* each corresponding to the normal nozzle 30C. Consequently, the pressure of the ink in pressure chambers B each corresponding to the high-viscosity nozzle 30B becomes higher than the pressure of the ink in pressure chambers B each corresponding to the normal nozzle 30C. As a result, more reliable ink ejection from the high-viscosity nozzle 30B can be achieved. Ink ejection from the high-viscosity nozzles 30B caused by the controller 8 applying the second drive waveform 72 to the high-viscosity individual electrode 322*d*B may be referred to below as "forced ejection".

Figure 8:
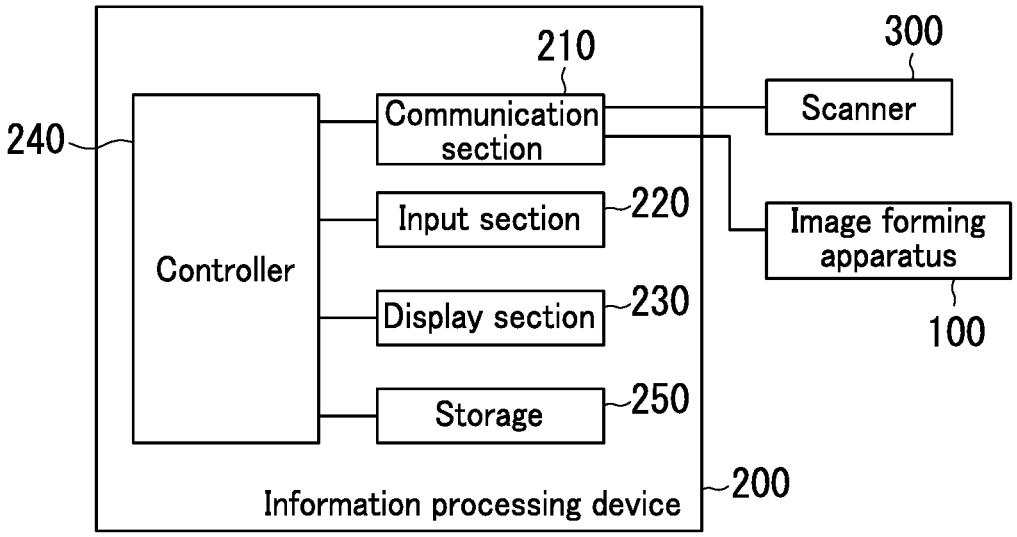
FIG. 8 is a block diagram illustrating a configuration of an information processing device communicatively connected to the image forming apparatus according to the embodiment of the present disclosure.

The following describes an information processing device 200 communicatively connected to the image forming apparatus 100 with reference to FIG. 8. FIG. 8 is a block diagram illustrating a configuration of the information processing device 200 communicatively connected to the image forming apparatus 100 in the present embodiment.

The information processing device 200 is communicatively connected to the image forming apparatus 100 and the scanner 300 via the network.

The scanner 300 reads for example a test pattern image formed on a sheet P by the image forming apparatus 100. As a result, the scanner 300 generates test pattern image data. The scanner 300 transmits the test pattern image data to the information processing device 200.

The information processing device 200 receives the test pattern image data from the scanner 300. The information processing device 200 receives an instruction from the user to generate non-ejection information. The non-ejection information contains information identifying an ejection disabled nozzle 30A. The information processing device 200 transmits the non-ejection information to the image forming apparatus 100.

The information processing device 200 includes a communication section 210, an input section 220, a display section 230, a controller 240, and storage 250. The information processing device 200 is for example a personal computer (PC).

The communication section 210 is connected to the network. The communication section 210 communicates with the image forming apparatus 100 and the scanner 300 via the network.

The input section 220 receives an instruction from the user. The input section 220 receives from the user for example position information for identifying the position of an ejection disabled nozzle 30A. The input section 220 includes for example a pointing device, a keyboard, or a touch panel.

The display section 230 displays various information. The display section 230 displays for example a test pattern image.

The controller 240 includes a CPU and the like. The controller 240 executes a second control program to control operation of the communication section 210, the input section 220, the display section 230, and the storage 250 of the information processing device 200.

The storage 250 includes RAM, ROM, and either or both of HDD and SSD. The storage 250 stores therein the second control program for controlling operation of each element of the information processing device 200.

For example, while the test pattern image is displayed on the display section 230, the user operates the input section 220 to identify the position of the ejection disabled nozzle 30A. As a result, the image forming apparatus 100 generates non-ejection information.

Figure 9:
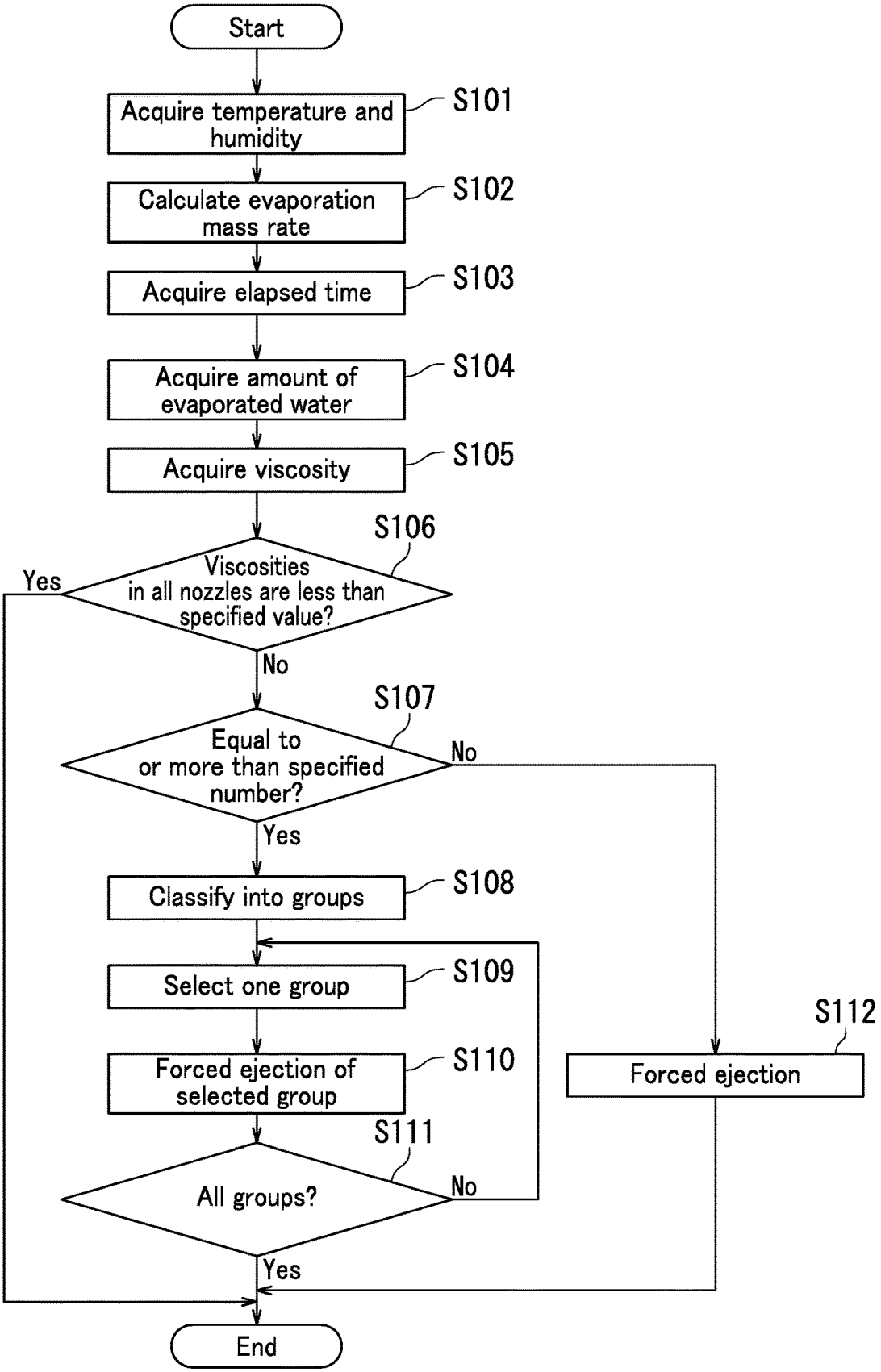
FIG. 9 is a flowchart illustrating a forced ejection process in the embodiment of the present disclosure.

Next, the forced ejection process will be described with reference to FIG. 9. The forced ejection process is a process of ejecting ink from the nozzle 30. FIG. 9 is a flowchart illustrating the forced ejection process performed by the image forming apparatus 100 in the present embodiment. The forced ejection process starts when the controller 8 receives an image formation instruction. The water-based ink in the present embodiment contains a pigment, glycerin, and water. Glycerin controls evaporation of water.

Step S101: The controller 8 acquires a temperature around the recording heads 32 based on an output of the temperature sensor S1. The controller 8 acquires a humidity around the recording heads 32 based on an output of the humidity sensor S2. The process proceeds to Step S102.

Step S102: The controller 8 uses a specific formula (1) to calculate an evaporation mass rate of ink based on the temperature around the recording heads 32 and the humidity around the recording heads 32. The following formula (1) is an example of the specific formula.

$$m = 2d \cdot D_w(C_s - C_\infty)\frac{P_v M}{TR} \tag{1}$$

In the formula (1), m represents an evaporation mass rate [kg/sec]. d represents a nozzle diameter [m] of each nozzle 30. $D_w$ represents a diffusion coefficient [$m^2$/sec] of water vapor. $C_s$ represents a mole fraction of water in the ink. $C_\infty$ represents a relative humidity. $P_v$ represents a vapor pressure [Pa]. M represents a molar concentration [kg/mol] of water in the ink. T represents an absolute temperature [K]. R represents a gas constant [Pa·$m^3$/K·mol].

The diffusion coefficient $D_w$ of water vapor, the molar fraction $C_s$ of water in the ink, and the molar concentration M of water in the ink in the formula (1) are determined depending on the type of the ink. The absolute temperature T in the formula (1) is determined based on the output of the temperature sensor S1. The relative humidity $C_\infty$ in the formula (1) is determined based on the output of the humidity sensor S2. The vapor pressure $P_v$ is determined by the controller 8 based on the output of the temperature sensor S1 and a vapor pressure conversion table. The vapor pressure conversion table shows vapor pressure corresponding to temperature. The storage 9 stores therein ink information, the vapor pressure conversion table, the formula (1), and the nozzle diameter d of the nozzles 30. The ink information contains information indicating a diffusion coefficient $D_w$ of water vapor, a molar fraction $C_s$ of water in the ink, and a molar concentration M of water in the ink according to the type of the ink.

Step S103: The controller 8 acquires, for each of the nozzles 30, an elapsed time that has elapsed from ink ejection based on an image pattern of image data for image formation on a sheet P. The process proceeds to Step S104.

Step S104: The controller 8 acquires an amount of water evaporated from the ink for each of the plurality of nozzles 30 based on the elapsed time and the evaporation mass rate of the ink. Specifically, the controller 8 calculates an amount of water evaporated from the ink by multiplying the evaporation mass rate of the ink by the elapsed time for each of the nozzles 30. The process proceeds to Step S105.

Step S105: The controller 8 acquires (calculates), for each of the nozzles 30, a viscosity of the ink in the nozzle 30 based on the amount of water evaporated from the ink and a viscosity conversion formula. The viscosity conversion formula gives a viscosity of ink corresponding to an amount of water evaporated from the ink. The storage 9 stores the viscosity conversion formula therein. Specifically, the controller 8 refers to the viscosity conversion formula, and acquires viscosities of the ink in the nozzles 30 based on the amount of water evaporated from the ink. The storage 9 stores the acquired viscosities of the ink in the respective nozzles 30. The process proceeds to Step S106.

Step S106: The controller 8 determines whether or not the respective viscosities of the ink in all the nozzles 30 are less than the threshold. The storage 9 stores the threshold therein. Specifically, the controller 8 determines, for each of the nozzles 30, whether or not the viscosity of the ink in the nozzle 30 is less than the threshold. In other words, the controller 8 determines whether or not the nozzle 30 is the high-viscosity nozzle 30B. When the controller 8 determines that the respective viscosities of the ink in all the nozzles 30 are less than the threshold (Yes in Step S106), that is, when the controller 8 determines that the number of high-viscosity nozzles 30B is zero, the process ends. When the controller 8 determines that not all the viscosities of the ink in all the nozzles 30 are less than the threshold (No in Step S106), that is, when the controller 8 determines that the number of high-viscosity nozzles 30B is not zero, the process proceeds to Step S107.

Step S107: The controller 8 counts the number of high-viscosity nozzles 30B. The controller 8 determines whether or not the number of high-viscosity nozzles 30B is equal to or more than a specified number. The storage 9 stores the specified number therein. When the controller 8 determines that the number of high-viscosity nozzles 30B is equal to or more than the specified number (Yes in Step S107), the process proceeds to Step S108. When the controller 8 determines that the number of high-viscosity nozzles 30B is less than the specified number (No in Step S107), the process proceeds to Step S112.

Step S108: The controller 8 classifies a plurality of high-viscosity nozzles 30B into groups. In the present embodiment, one group corresponds to one recording head 32. That is, the controller 8 classifies the high-viscosity nozzles 30B into groups by identifying a recording head 32 to which each high-viscosity nozzle 30B belongs. The storage 9 stores the recording heads 32 (groups) to which each high-viscosity nozzle 30B belongs. The process proceeds to Step S109.

Step S109: The controller 8 selects one group from the groups. The process proceeds to Step S110.

Step S110: When forming an image on a sheet P, the controller 8 causes forced ejection of ink from each high-viscosity nozzle 30B belonging to the selected group. Specifically, when forming an image on a sheet P, the controller 8 applies the second drive waveform 72 to individual electrodes 322*d* each corresponding the high-viscosity nozzle 30B belonging to the selected group. The process proceeds to Step S111. The number of times of the forced ejection of the ink from each high-viscosity nozzle 30B may be one.

Step S111: The controller 8 determines whether or not all of the groups have been selected. When the controller 8 determines that all of the groups have been selected (Yes in Step S111), the process ends. When the controller 8 determines that not all of the groups have been selected (No in Step S111), the process returns to Step S109.

Step S112: When forming an image on a sheet P, the controller 8 causes forced ejection of ink from each high-viscosity nozzle 30B. Specifically, when forming an image on a sheet P, the controller 8 applies the second drive waveform 72 to the high-viscosity individual electrode 322*d*B. The process ends. The number of times of the forced ejection of the ink from each high-viscosity nozzle 30B may be one.

Figure 10:
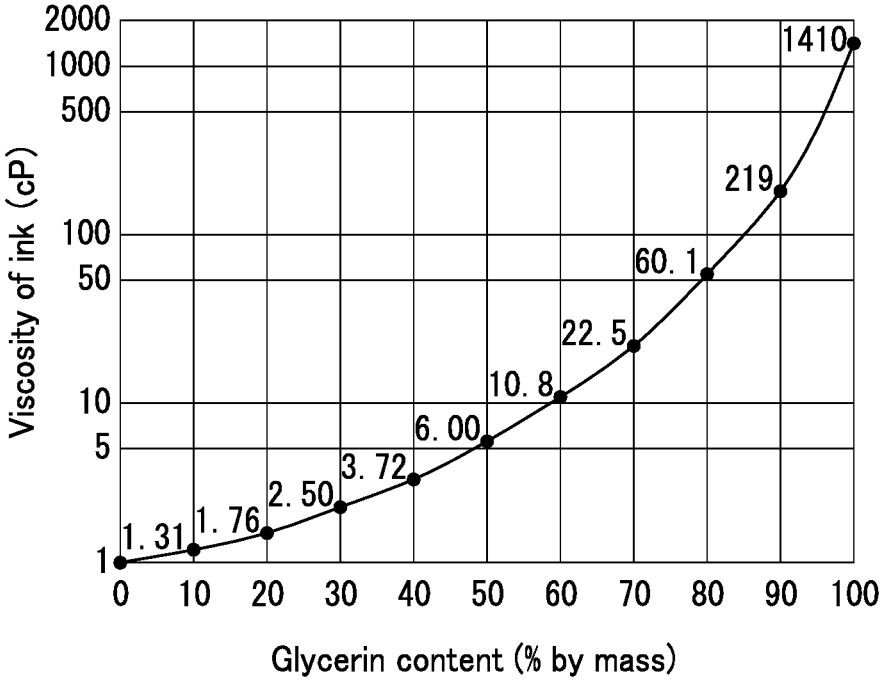
FIG. 10 is a viscosity conversion graph illustrating a relationship between glycerin content and viscosity of ink.

Next, the viscosity conversion formula will be described with reference to FIG. 10. FIG. 10 is a viscosity conversion graph illustrating a relationship between glycerin content and viscosity of ink. In FIG. 10, the horizontal axis represents glycerin content (% by mass), and the vertical axis represents viscosity of ink. The viscosity conversion formula is given based on the viscosity conversion graph.

The controller 8 calculates a glycerin content (% by mass) for each of the nozzles 30 based on the amount of water evaporated from the ink. The glycerin content (% by mass) is the mass of the glycerin relative to the mass of liquid content in the ink other than solid content. The mass of the liquid content in the ink other than the solid content will be referred to below as the "mass of liquid content". The mass of liquid content and the mass of the glycerin are determined depending on the type of the ink in the initial state. The mass of liquid content in the initial state will be referred to below as the "mass of initial liquid content". The controller 8 calculates the glycerin content (% by mass) by calculating a ratio of the mass of the glycerin relative to the mass obtained by subtracting the amount of water evaporated from the ink from the mass of initial liquid content. As illustrated in FIG. 10, the viscosity of the ink can be determined from the glycerin content (% by mass). The controller 8 calculates a viscosity of the ink corresponding to the calculated glycerin content (% by mass) using the viscosity conversion formula.

Figure 11:
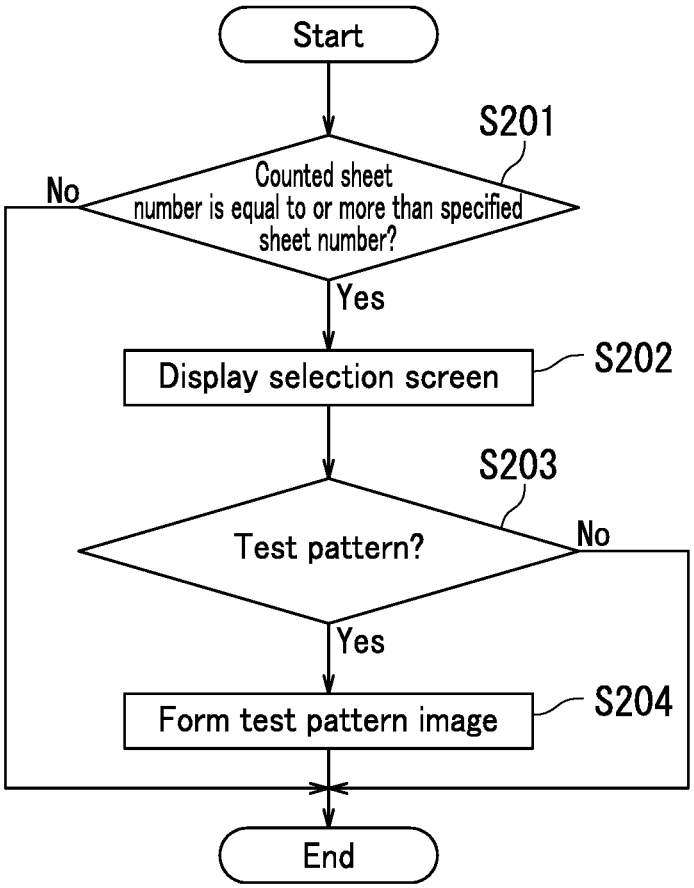
FIG. 11 is a flowchart illustrating a test-pattern-image forming process in the embodiment of the present disclosure.

Next, the test-pattern-image forming process will be described with reference to FIG. 11. The test-pattern-image forming process is a process for causing the image forming apparatus 100 to form a test pattern image. FIG. 11 is a flowchart illustrating the test-pattern-image forming process performed by the image forming apparatus 100 in the present embodiment. The test-pattern-image forming process starts in response to the end of an image forming job. The image forming job is a job of forming an image on a sheet P.

Step S201: The controller 8 determines whether or not the counted sheet number is equal to or more than a specified sheet number. The storage 9 stores the specified sheet number therein. When the controller 8 determines that the counted sheet number is equal to or more than the specified sheet number (Yes in Step S201), the process proceeds to Step S202. When the controller 8 determines that the counted sheet number is less than the specified sheet number (No in Step S201), the process ends.

Step S202: The controller 8 causes the display section 61 to display a selection screen. The selection screen includes an image for allowing the user to select formation or non-formation of the test pattern image. The storage 9 stores therein the screen information for displaying the selection screen. The process proceeds to Step S203.

Step S203: The controller 8 determines whether or not to form the test pattern image. That is, the controller 8 determines whether or not the operation panel 6 has received an instruction to form the test pattern image. When the controller 8 determines to form the test pattern image (Yes in Step S203), the process proceeds to Step S204. When the controller 8 determines not to form the test pattern image (No in Step S203), the process ends.

Step S204: The controller 8 causes the image forming section 3 to form the test pattern image. The process ends.

As described with reference to FIG. 8, the user causes the scanner 300 to read the test pattern image formed on a sheet P, and causes the display section 230 of the information processing device 200 to display the test pattern image. The user operates the input section 220 to cause the information processing device 200 to generate non-ejection information.

Figure 12:
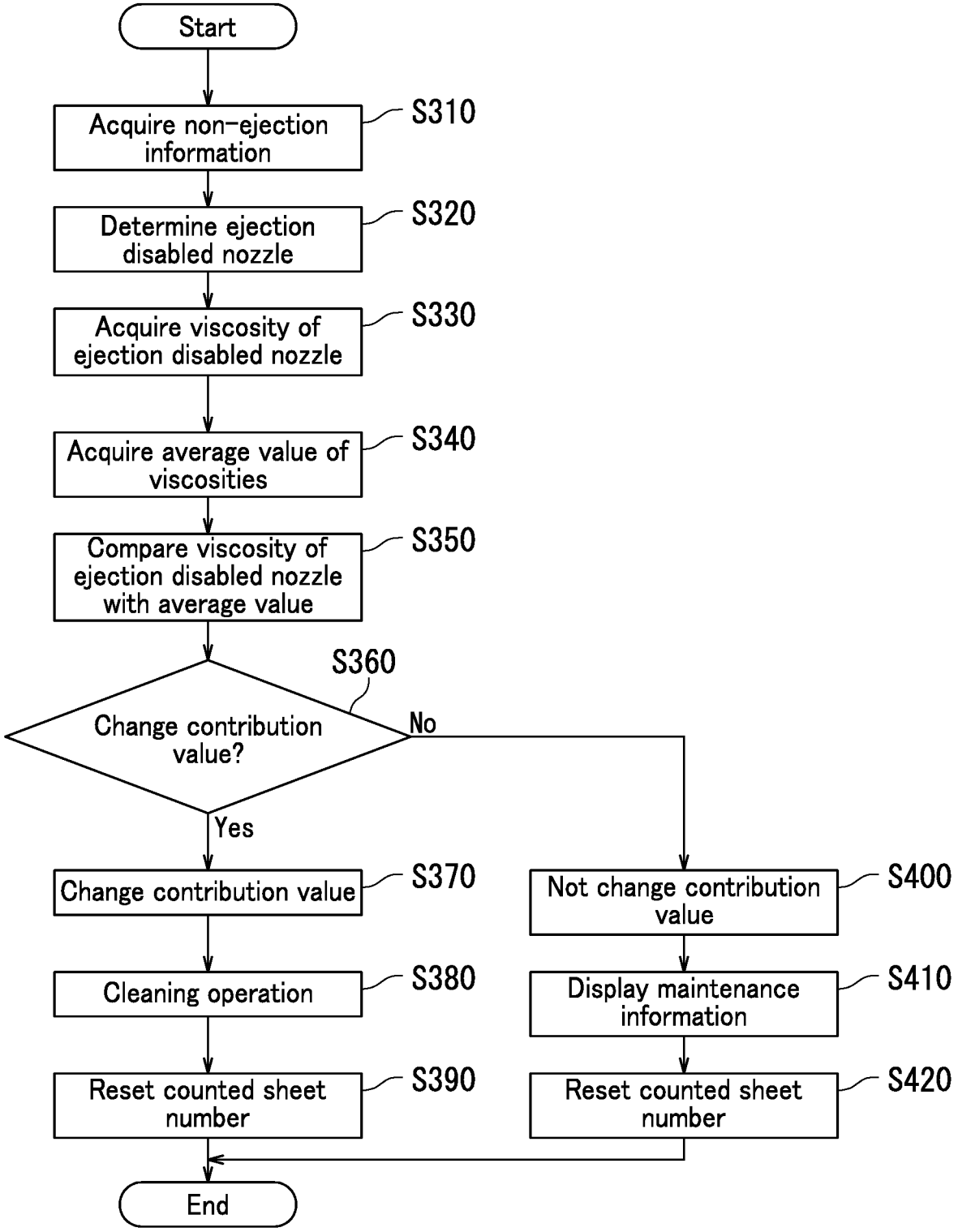
FIG. 12 is a flowchart illustrating a cleaning process in the embodiment of the present disclosure.

Next, the cleaning process will be described with reference to FIG. 12. The cleaning process is a process related to cleaning of the ejection disabled nozzle 30A. FIG. 12 is a flowchart illustrating the cleaning process performed by the image forming apparatus 100 in the present embodiment. The cleaning process starts in response to input of non-ejection information to the image forming apparatus 100. Specifically, the user operates the information processing device 200 to send the non-ejection information from the information processing device 200 to the image forming apparatus 100.

Step S310: The controller 8 acquires non-ejection information. The process proceeds to Step S320.

Step S320: The controller 8 determines an ejection disabled nozzle 30A among the nozzles 30 based on the non-ejection information. The process proceeds to Step S330.

Step S330: The controller 8 acquires the viscosity of the ink in the ejection disabled nozzle 30A. When there are two or more ejection disabled nozzles 30A, the controller 8 acquires the viscosity of the ink in each of the ejection disabled nozzles 30A. The process proceeds to Step S340.

Step S340: The controller 8 calculates an average value of the viscosities of the ink in all of the nozzles 30. The process proceeds to Step S350. The all of the nozzles 30 may be simply referred to below as nozzles 30.

Step S350: The controller 8 compares the viscosity of the ink in the ejection disabled nozzle 30A with the average value of the viscosities of the ink in the nozzles 30. When there are two or more ejection disabled nozzles 30A, the controller 8 compares the viscosity of each of the ejection disabled nozzles 30A with the average value of the viscosities of the ink in the nozzles 30.

Step S360: The controller 8 determines whether or not to change a contribution value based on a comparison result of the viscosity of the ink in the ejection disabled nozzle 30A with the average value of the viscosities of the ink in the nozzles 30. The contribution value is a value that contributes to a result of determination by the controller 8 as to whether or not each of the nozzles 30 is the high-viscosity nozzle. In the present embodiment, the contribution value is a threshold.

When the viscosity of the ink in the ejection disabled nozzle 30A is equal to or higher than the average value, the controller 8 determines to change the contribution value. In a situation in which there are two or more ejection disabled nozzles 30A, when the viscosity of the ink in at least one ejection disabled nozzle 30A of the ejection disabled nozzles 30A is equal to or higher than the average value, the controller 8 determines to change the contribution value. When the controller 8 determines to change the contribution value (Yes in Step S360), the process proceeds to Step S370.

When the viscosity of the ink in the ejection disabled nozzle 30A is less than the average value, the controller 8 determines not to change the contribution value. In a situation in which there are two or more ejection disabled nozzles 30A, when the viscosities of the ink in all the ejection disabled nozzles 30A are less than the average value, the controller 8 determines not to change the contribution value. When the controller 8 determines not to change the contribution value (No in Step S360), the process proceeds to Step S400.

Step S370: The controller 8 changes the threshold that is a first example of the contribution value. Specifically, the controller 8 reduces the threshold. For example, the larger the difference between the viscosity of the ink in the ejection disabled nozzle 30A and the average value of the viscosities of the ink in the nozzles 30, the smaller threshold the controller 8 sets. The storage 9 stores the changed threshold. The process proceeds to Step S380.

Step S380: The controller 8 causes the cleaner 5 to clean the four lineheads 31 as described with reference to FIG. 1. Specifically, the controller 8 causes forced ejection (purging) of the ink from the nozzles 30. Next, the controller 8 causes the wiping section 52 to clean the nozzle surfaces 3S of the four lineheads 31. The process proceeds to Step S390.

Step S390: The controller 8 resets the counted sheet number stored in the storage 9. The process ends.

Step S400: The controller 8 does not change the threshold that is the contribution value. The process proceeds to Step S410.

Step S410: The controller 8 causes the display section 61 to display maintenance information. The maintenance information prompts maintenance of a recording head 32. Specifically, the maintenance information displays a warning image indicating that there is an ejection disabled nozzle 30A in which a fault irrespective of the viscosity of the ink in the nozzles 30 has occurred. The storage 9 stores the maintenance information therein. The process proceeds to Step S420.

Step S420: The controller 8 resets the counted sheet number stored in the storage 9. The process ends.

As described with reference to FIGS. 1 to 12, the image forming apparatus 100 includes the recording heads 32, the controller 8, the temperature sensor S1, and the humidity sensor S2. The controller 8 acquires, for each of the nozzles 30, an elapsed time that has elapsed from ink ejection. The controller 8 calculates, for each of the nozzles 30, a viscosity of the ink in the nozzle based on the temperature, the humidity, and the elapsed time. The controller 8 determines, for each of the nozzles 30, whether or not the viscosity of the ink in the nozzle 30 is equal to or higher than the threshold. Among the nozzles 30, a nozzle 30 in which the viscosity of the ink is equal to or higher than the threshold is determined to be the high-viscosity nozzle 30B by the controller 8. Accordingly, the image forming apparatus 100 can predict a high-viscosity nozzle 30B among the nozzles 30. A high-viscosity nozzle 30B is more likely to be the ejection disabled nozzle 30A than the normal nozzle 30C. For example, the image forming apparatus 100 causes forced ink ejection from the high-viscosity nozzle 30B, thereby efficiently preventing the viscosity of the ink in the high-viscosity nozzle 30B from becoming the viscosity of the ink in the ejection disabled nozzle 30A with a small amount of ink ejection. As a result, the image forming apparatus 100 can inhibit occurrence of an ejection disabled nozzle 30A.

As described with reference to FIGS. 1 to 12, each recording head 32 has a plurality of pressure chambers B and a plurality of piezoelectric elements 322*c*. The controller 8 generates a drive voltage to be input to each of the plurality of piezoelectric elements 322*c*. The controller 8 inputs a driving voltage to a piezoelectric element 322*c* of the piezoelectric elements 322*c* that corresponds to the high-viscosity nozzle 30B when forming an image on a sheet P. That is, on prediction of a high-viscosity nozzle 30B, the image forming apparatus 100 causes forced ink ejection from each high-viscosity nozzle 30B when forming an image on a sheet P regardless of the image pattern of the image data for forming the image on the sheet P. As a result, the image forming apparatus 100 can inhibit occurrence of an ejection disabled nozzle 30A in a more reliable manner in a shorter period of time.

As described with reference to FIGS. 1 to 12, the controller 8 determines whether or not the number of high-viscosity nozzles 30B is equal to or more than a specified number. When the controller 8 determines that the number of high-viscosity nozzles 30B is equal to or more than the specified number, the controller 8 classifies the high-viscosity nozzles 30B into groups. The controller 8 selects one group from the groups. The controller 8 inputs a driving voltage to high-viscosity nozzles 30B belonging to the selected group. The controller 8 changes the selected group each time the recording heads 32 form an image on a sheet P. That is, the image forming apparatus 100 does not cause forced ejection from all the high-viscosity nozzles 30B at a time, but causes forced ejection in multiple times. As a result, the image forming apparatus 100 can inhibit quality degradation of an image formed on a sheet P, as compared to the case where forced ejection from all the high-viscosity nozzles 30B is performed at a time. Further, the image forming apparatus 100 can reduce the viscosity of the ink in the high-viscosity nozzle 30B without stopping the image forming process.

As described with reference to FIGS. 1 to 12, the controller 8 increases the difference in the drive voltage input to the piezoelectric elements 322*c* corresponding to each high-viscosity nozzle 30B as compared to the difference in the drive voltage input to the piezoelectric elements 322*c* corresponding to other nozzles 30 than the high-viscosity nozzles 30B. That is, the controller 8 controls the drive voltage in such a way that the difference in the drive voltage input to piezoelectric elements 322*c* each corresponding to the high-viscosity nozzle 30B is larger than the difference in the drive voltage input to piezoelectric elements 322*c* each corresponding to the normal nozzle 30C. As a result, the piezoelectric elements 322*c* each corresponding to the high-viscosity nozzle 30B change in shape greater than the piezoelectric elements 322*c* each corresponding to the normal nozzle 30C. Consequently, the pressure of the ink in pressure chambers B each corresponding to the high-viscosity nozzle 30B becomes higher than the pressure of the ink in pressure chambers B each corresponding to the normal nozzle 30C. As a result, the image forming apparatus 100 can cause more reliable ink ejection from the high-viscosity nozzle 30B.

As described with reference to FIGS. 1 to 12, the controller 8 acquires non-ejection information. The controller 8 acquires the viscosity of the ink in an ejection disabled nozzle 30A among the nozzles 30 based on the non-ejection information. The controller 8 calculates an average value of the viscosities of the ink in the nozzles 30. The controller 8 determines whether or not the viscosity of the ink in an ejection disabled nozzle 30A is equal to or higher than the average value. When determining that the viscosity of the ink in the ejection disabled nozzle 30A is equal to or higher than the average value of the viscosities of the ink in the nozzles 30, the controller 8 changes the threshold. In this way, the image forming apparatus 100 can set a more appropriate threshold according to for example the environment in which the image forming apparatus 100 is located. Accordingly, the image forming apparatus 100 can predict a high-viscosity nozzle 30B among the nozzles 30 with higher accuracy. As a result, the image forming apparatus 100 can more reliably inhibit occurrence of an ejection disabled nozzle 30A.

As described with reference to FIGS. 1 to 12, the image forming apparatus 100 further includes a display section 61. When determining that the viscosity of the ink in the ejection disabled nozzle 30A is less than the average value, the controller 8 causes the display section 61 to display the maintenance information. As a result, the image forming apparatus 100 can notify the user that there is a nozzle 30 that is highly likely to have become an ejection disabled nozzle 30A due to a factor irrespective of the viscosity of the ink.

As described with reference to FIGS. 1 to 12, when the viscosity of the ink in an ejection disabled nozzle 30A is not less than the average value (is equal to or higher than the average value) in Steps S350 to S370, the image forming apparatus 100 determines that the threshold is inappropriate and changes the threshold. Specifically, the controller 8 reduces the threshold to lower a standard based on which the controller 8 determines a high-viscosity nozzle 30B in Step S106 in FIG. 9.

The following describes a reason why the standard for determining the high-viscosity nozzle 30B is to be lowered by the controller 8.

When the threshold is excessively large, even a nozzle 30 clogged due to high viscosity of the ink therein may be determined not to be a high-viscosity nozzle 30B as a result of the viscosity of the ink being less than the threshold in Step S106 in FIG. 9. A nozzle 30 determined not to be the high-viscosity nozzle 30B in Step S106 despite clogging due to high viscosity of the ink having been occurred therein may be referred to below as misjudged nozzle.

The misjudged nozzle is determined not to be a high viscosity nozzle 30B in Step S106. As a result, forced ejection process is not performed in Step S110 or Step S112, and the clogged state is not resolved. The misjudged nozzle, which is used in its clogged state, does not eject ink. Consequently, the misjudged nozzle is determined to be the ejection disabled nozzle 30A in Step S320.

In view of the foregoing, in order to prevent the misjudged nozzle from becoming the ejection disabled nozzle 30A, the forced ejection process in Step S110 or Step S112 should be performed on the misjudged nozzle.

For this reason, in the present embodiment, the threshold is reduced to lower the standard for determining the high-viscosity nozzle 30B. As a result, the high-viscosity nozzle 30B is less likely to be misjudged, and thus is less likely to become the ejection disabled nozzle 30A.

As described with reference to FIGS. 1 to 12, when the viscosity of the ink in the ejection disabled nozzle 30A is less than the average value in Steps S350 to S370, the controller 8 does not change the threshold.

The following describes a reason why the threshold is not to be changed by the controller 8.

When the viscosity of the ink in the ejection disabled nozzle 30A is less than the average value, the reason for the ejection disabled nozzle 30A not ejecting the ink therefrom is presumably one other than high viscosity of the ink. In this case, since there is no problem in the result that the nozzle 30 is not a high viscosity nozzle 30B determined by the controller 8 in Step S106 in FIG. 9, the threshold is not changed.

Hereinbefore, an embodiment of the present disclosure has been described with reference to the drawings (FIGS. 1 to 12). However, the present disclosure is not limited to the above embodiment and may be implemented in various different forms that do not deviate from the essence of the present disclosure (for example, (1) to (7) shown below). The drawings schematically illustrate elements of configuration in order to facilitate understanding, and properties of elements of configuration illustrated in the drawings, such as thicknesses, lengths, and numbers thereof, may differ from actual properties thereof in order to facilitate preparation of the drawings. Materials, shapes, dimensions, and the like of the elements of configuration given in the above embodiment are merely examples that do not impose any particular limitations and may be altered in various ways so long as such alterations do not substantially deviate from the effects of the present disclosure.

(1) As described with reference to FIGS. 1 to 12, the controller 8 applies the second drive waveform 72 to the high-viscosity individual electrode 322*d*B when forming an image on a sheet P. However, the present disclosure is not limited thereto. For example, when forming an image on a sheet P, the controller 8 may apply the first drive waveform 71 to the high-viscosity individual electrode 322*d*B instead of the second drive waveform 72.

(2) As described with reference to FIGS. 1 to 12, the controller 8 applies the second drive waveform 72 to the high-viscosity individual electrode 322*d*B when forming an image on a sheet P. However, the present disclosure is not limited thereto. For example, when forming an image on a sheet P, the controller 8 may apply a third drive waveform to the high-viscosity individual electrode 322*d*B instead of the second drive waveform 72. The third drive waveform is a waveform of the drive voltage that causes the meniscus of the ink in the high-viscosity nozzle 30B to pulsate. When the third drive waveform is applied to the high-viscosity individual electrode 322*d*B, the ink in the high-viscosity nozzle 30B is agitated without being ejected from the high-viscosity nozzle 30B. Accordingly, the image forming apparatus 100 can prevent the viscosity of the ink in the high-viscosity nozzle 30B from becoming the viscosity of the ink in the ejection disabled nozzle 30A without ejecting the ink from the high-viscosity nozzle 30B. As a result, the image forming apparatus 100 can inhibit occurrence of an ejection disabled nozzle 30A.

(3) As described with reference to FIGS. 1 to 12, when determining that the viscosity of the ink in the ejection disabled nozzle 30A is equal to or higher than the average value of viscosities of the ink in the nozzles 30, the controller 8 changes the threshold. However, the present disclosure is not limited thereto. For example, the controller 8 may change the formula (1) instead of changing the threshold. Specifically, the controller 8 may reduce the diffusion coefficient $D_w$ of water vapor in the formula (1). For example, the larger the difference between the viscosity of the ink in the ejection disabled nozzle 30A and the average value of the viscosities of the ink in the nozzles 30, the more the controller 8 reduces the diffusion coefficient $D_w$ of water vapor in the formula (1). As a result, the standard for determining the high-viscosity nozzle 30B is lowered, and therefore, the misjudged nozzle is less likely to determined. Accordingly, the image forming apparatus 100 can predict the high-viscosity nozzle 30B among the nozzles 30 with higher accuracy. As a result, the image forming apparatus 100 can more reliably inhibit occurrence of an ejection disabled nozzle 30A. The diffusion coefficient $D_w$ is a second example of the contribution value of the present disclosure.

(4) As described with reference to FIGS. 1 to 12, the image forming apparatus 100 does not include a reading section that reads a test pattern image formed on a sheet P to generate test pattern image data. However, the present disclosure is not limited thereto. The image forming apparatus 100 may include a reading section. The reading section includes a scanner and an imaging section. The imaging section includes for example a line sensor. The imaging section is disposed for example on a conveyance path for the sheet P. When including such a reading section, the image forming apparatus 100 may cause the display section 61 to display a test pattern image. Furthermore, when including such a reading section, the image forming apparatus 100 may receive operation by a user through an operation buttons 62 to generate non-ejection information.

(5) As described with reference to FIGS. 1 to 12, the controller 8 acquires, for each of the nozzles 30, a viscosity of the ink in the nozzle 30 based on the amount of water evaporated from the ink and a viscosity conversion formula. However, the present disclosure is not limited thereto. The controller 8 may acquire, for each of the nozzles 30, a viscosity of the ink in the nozzle 30 based on the amount of water evaporated from the ink and a viscosity conversion graph or a viscosity conversion table. The viscosity conversion table is created based on a viscosity conversion graph or a viscosity conversion formula. In a configuration in which the controller 8 acquires a viscosity of the ink using such a viscosity conversion graph or such a viscosity conversion table, the storage 9 stores the viscosity conversion graph or the viscosity conversion table therein. The viscosity conversion table gives a viscosity of the ink corresponding to an amount of water evaporated from the ink.

(6) As described with reference to FIGS. 1 to 12, the image forming section 3 includes lineheads 31. However, the present disclosure is not limited thereto. The image forming section 3 may include serial heads.

(7) As described with reference to FIGS. 1 to 12, the ink ejection method of the image forming section 3 is a piezoelectric inkjet method. However, the present disclosure is not limited thereto. The ink ejection method of the image forming section 3 may be a thermal inkjet method.

What is claimed is:

1. An image forming apparatus comprising:

a recording head including a plurality of nozzles that eject ink to form an image on a sheet with the ink;

a controller configured to control the recording head;

a first detector configured to detect a temperature around the recording head; and a second detector configured to detect a humidity around the recording head; wherein the controller acquires, for each of the nozzles, an elapsed time that has elapsed from ink ejection;

calculates, for each of the nozzles, a viscosity of the ink in the nozzle by multiplying an evaporation mass rate of the ink by the elapsed time, the evaluation mass rate of the ink including a product obtained by multiplying a product of the humidity and a reciprocal of the temperature by a diffusion coefficient of water vapor determined depending on a type of the ink;

determines, for each of the nozzles, whether or not the viscosity of the ink in the nozzle is equal to or higher than a threshold;

determines, among the nozzles, a nozzle in which the viscosity of the ink is equal to or higher than the threshold to be a high-viscosity nozzle;

acquires non-ejection information indicating an ejection disabled nozzle that is disabled to eject the ink through reading a test pattern image;

acquires the viscosity of the ink in the ejection disabled nozzle based on the non-ejection information;

calculates an average value of viscosities of the ink in the nozzles;

compares the viscosity of the ink in the ejection disabled nozzle with the average value of the viscosities of the ink in the nozzles; and determines whether or not to change a contribution value based on a comparison result between the viscosity of the ink in the ejection disabled nozzle and the average value of the viscosities of the ink in the nozzles, the contribution value is a value that contributes to a result of determination by the controller as to whether or not any of the nozzles is the high-viscosity nozzle, the contribution value is the diffusion coefficient of the water vapor, the larger a difference is, the more controller reduces the diffusion coefficient of the water vapor, the difference being a difference between the viscosity of the ink in the ejection disabled nozzle and the average value of the viscosities of the ink in the nozzles.

2. The image forming apparatus according to claim 1, wherein the controller determines to change the contribution value when the viscosity of the ink in the ejection disabled nozzle is determined to be equal to or higher than the average value, and determines not to change the contribution value when the viscosity of the ink in the ejection disabled nozzle is determined to be less than the average value.

3. The image forming apparatus according to claim 1, wherein the contribution value is the threshold.

4. The image forming apparatus according to claim 1, wherein the controller calculates the viscosity of the ink in each of the nozzles based on a specific formula, and the contribution value is a value included in the specific formula.

5. The image forming apparatus according to claim 1, further comprising a display section that displays maintenance information prompting maintenance of the recording head, wherein the controller causes the display section to display the maintenance information when determining not to change the contribution value.

* * * * *